US006129352A

United States Patent [19]

Stâb

[11] Patent Number: 6,129,352

[45] Date of Patent: Oct. 10, 2000

[54] DEVICE FOR DISTRIBUTING A FLOW OF SIGNATURES

[75] Inventor: Rudolf Stâb, Frankenthal, Germany

[73] Assignee: Koenig & Bauer-Albert Aktiengesellschaft, Wurzburg, Germany

[21] Appl. No.: 09/308,637

[22] PCT Filed: Nov. 26, 1997

[86] PCT No.: PCT/DE97/02764

§ 371 Date: May 28, 1999

§ 102(e) Date: May 28, 1999

[87] PCT Pub. No.: WO98/23517

PCT Pub. Date: Jun. 4, 1998

[30] Foreign Application Priority Data

Nov. 28, 1996 [DE] Germany ..... 196 49 326

[51] Int. Cl.[7] ..... B65H 39/10

[52] U.S. Cl. ..... 271/302; 271/303

[58] Field of Search ..... 271/302, 303

[56] References Cited

U.S. PATENT DOCUMENTS

| | | | |
|---|---|---|---|
| 4,008,891 | 2/1977 | Buys | 271/263 |
| 4,373,713 | 2/1983 | Loebach . | |
| 4,538,800 | 9/1985 | Richter . | |
| 4,729,282 | 3/1988 | Kasdorf . | |
| 5,702,100 | 12/1997 | Novick et al. | 271/303 X |

FOREIGN PATENT DOCUMENTS

| | | |
|---|---|---|
| 0054963B1 | 6/1982 | European Pat. Off. . |
| 0089407A1 | 9/1983 | European Pat. Off. . |
| 0254037 | 1/1988 | European Pat. Off. . |

*Primary Examiner*—David H. Bollinger
*Attorney, Agent, or Firm*—Jones, Tullar & Cooper, PC

[57] ABSTRACT

In a device comprised of two rotating cam rollers that are spaced apart from each other by a nip, which device is for distributing a flow of signatures, first and second conveyor belts are disposed so that they can be moved cyclically back and forth onto the guide face of a guide tab respectively associated with them.

14 Claims, 3 Drawing Sheets

DEVICE FOR DISTRIBUTING A FLOW OF SIGNATURES

FILED OF THE INVENTION

DESCRIPTION OF THE PRIOR ART

The present invention relates to a device for distributing a flow of signatures. The signatures are divided into two partial flows or steams by first and second rotating cam rollers, a guide tab or tongue, and a conveyor belt system which includes two conveyor belts.

EP 00 54 963 B1 has disclosed a device for distributing a flow of signatures or the like into two partial flows of signatures using a first rotating cam roller with cams and second a second rotating roller with cams.

The cams of the two cam rollers mesh with each other to form a nip with a conveyor belt system, comprised of first conveyor belts near the first cam roller and conveyor belts near the second cam roller, which jointly exert a clamping action on the signatures. After passing through the nip, the first and second conveyor belts diverge from each other to form an outlet nip region. In the outlet nip region, a cross sectionally wedge-shaped guide tab is provided, with its sharp edge pointing into the nip.

SUMMARY OF THE INVENTION

The present first and second conveyor belts respectively travel along guide faces of the guide tab, spaced apart from them.

EP 02 54 037 A2 describes a device for distributing a flow of signatures by means of a conveyor belt system. In this connection, the conveyor belts are deflected by means of eccentric rollers.

The object of the invention is to produce a device for distributing a flow of signatures into two partial flows of signatures.

This object is attained according to the invention by the use of a device which utilizes a pair of rotating cam rollers and a conveyor belt system. The conveyor belt system has first and second conveyor belts which exert a clamping force on the signatures after they have passed through the nip that is defined by the cam rollers. The two conveyor belts diverge from each other and form an outlet region. The two conveyor belts can be moved to distribute the flow of signatures into two partial flows of signatures.

The advantages that can be attained with the invention are comprised in that two rollers provided with cams on their circumference faces can perform several functions at the same time. In addition to the distribution of a flow of signatures into two partial flows of signatures, a direction change of the signatures can be executed without additional guide rollers being required for the conveyor belts. A direction change and distribution of signatures is required when as a result of excessive production speed, a signature flow cannot be processed in a single subsequent unit and consequently must be divided into two partial signature flows, e.g. must be processed further in separate longitudinal folding devices—second longitudinal fold —disposed one above the other.

The circumferences or control faces of the two cam rollers are also used for belt guidance so that separate belt guides can be eliminated. Furthermore, particularly in the processing of thick signatures, it is advantageous if a second one of the two cam rollers has a larger circumference than a first one of the two cam rollers.

It is advantageous that a roller for deflecting the conveyor belt system is wound around by the conveyor belt system by at least 45°. Consequently, a reliable guidance of the signatures is assured.

It is also advantageous that the roller for deflecting the conveyor belt system has a circumference length which is at least three times the maximal length of the signatures to be transported.

As a result, less damaging movement forces are produced between the inner and outer layers of the signatures when they are deflected, i.e. in the direction change.

BRIEF DESCRIPTION OF THE DRAWINGS

A preferred embodiment of the present invention is depicted in the drawings and will be described in more detail below.

DESCRIPTION OF THE PREFERRED EMBODIMENT

Figure 1:
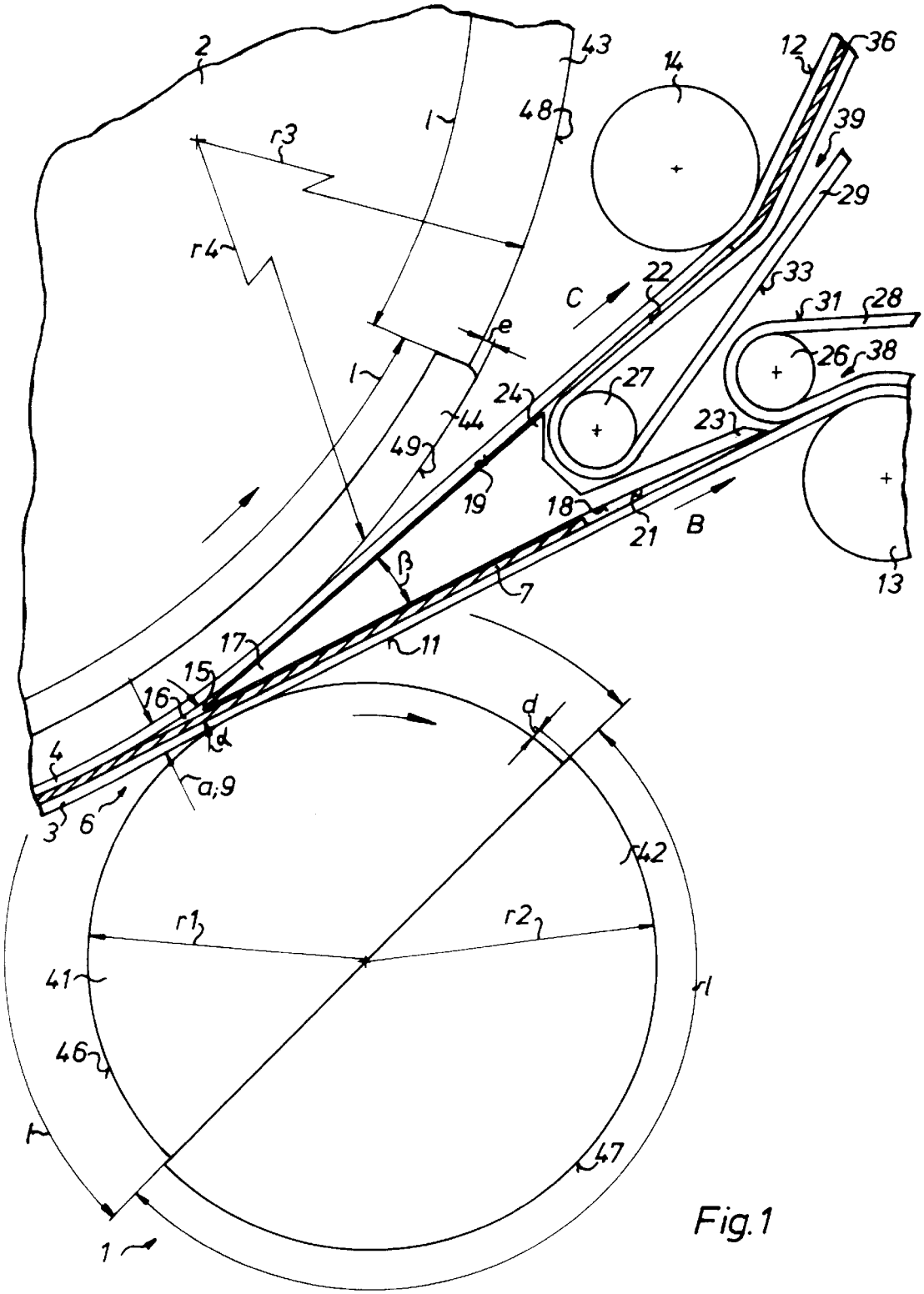
FIG. 1 shows a cross section through a device for distributing a flow of signatures in a first working of the device, with the clearing of a first transport path for the signatures.
Figure 2:
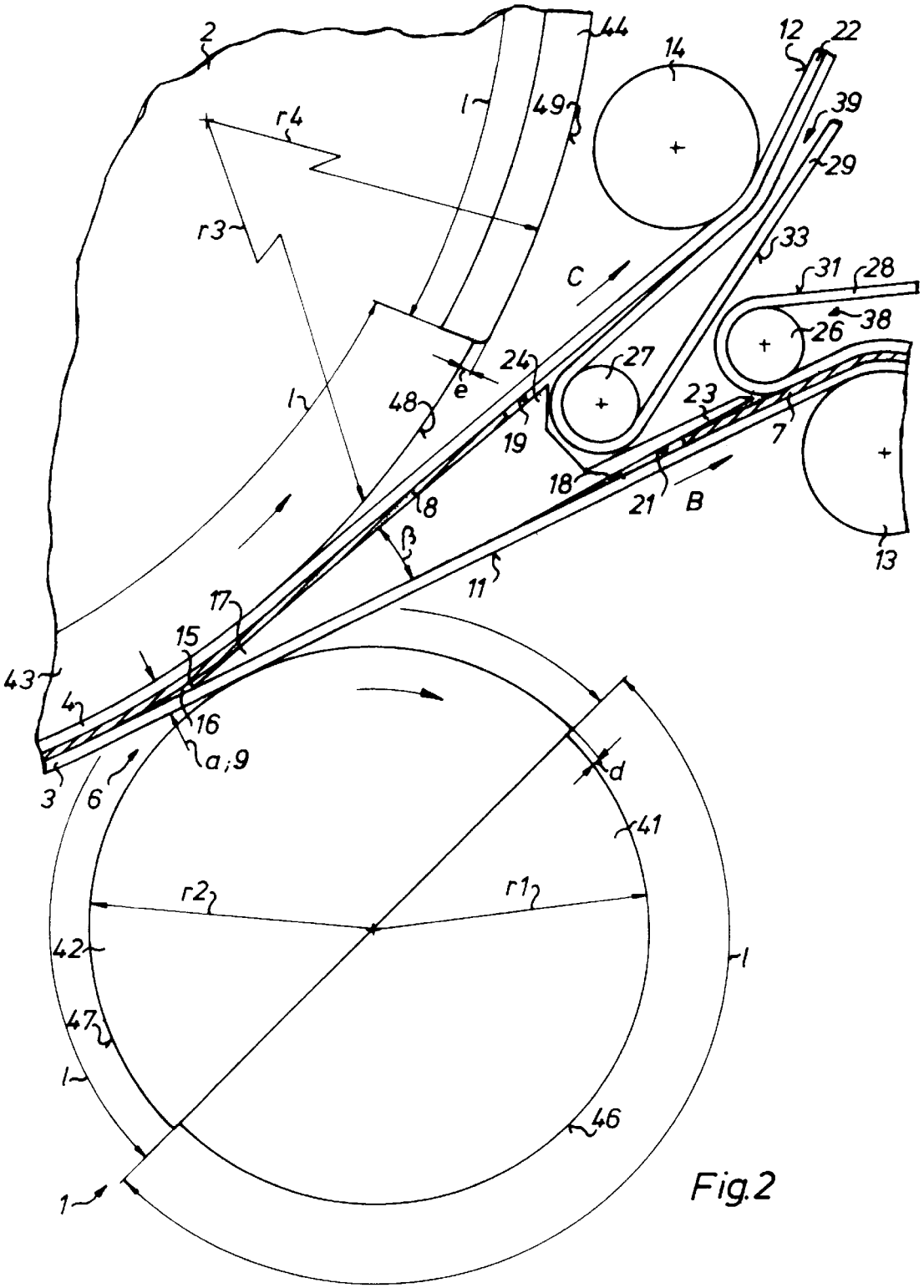
FIG. 2 shows a device according to FIG. 1, but in a second work position with the clearing of a second transport path for the signatures.
Figure 3:
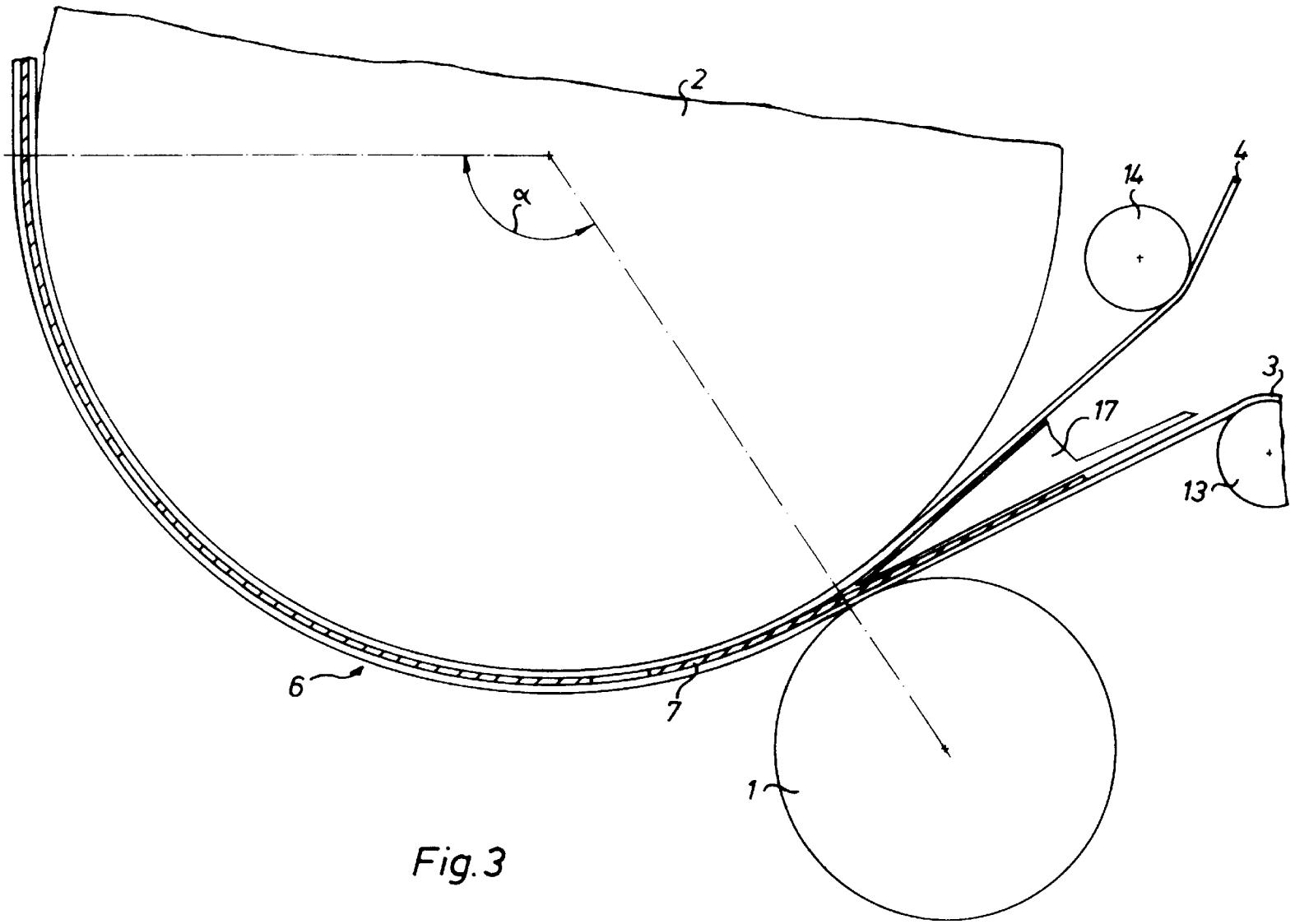
FIG. 3 is a reduced depiction of the device according to FIGS. 1 and 2.

Referring initially to FIGS. 1 and 2, the device for distributing a flow of signatures, in accordance with the present invention, is essentially comprised of a first roller, for example a first cam roller 1, and a second roller, for example a second cam roller 2, which can be driven together and which are disposed axially parallel to each other. The second cam roller 2, and also the first cam roller 1, can be embodied as deflection rollers which are used to deflect a first belt system 6 e.g. by at least 45°, and preferably between 90° and 180°. In the embodiment, the circumference of the second cam roller 2 is slightly larger and is wound around through more than 90° by the belt system 6 that is comprised of lower and upper conveyor belts 3; 4. Between the conveyor belts 3; 4 and "clamped in" by them, signatures 7; 8; 36 that are spaced apart from one another, are transported in a frictionally engaged fashion. Signatures 7; 8; 36 are comprised, in a known manner, of one or a number of paper webs, with layers of one or a number of sheets produced by means of lateral cutting. They can be folded or unfolded.

The lower and upper conveyor belts 3; 4 travel into a nip 9 between the cam rollers 1; 2 and subsequently separate from each other at an acute opening angle or, e.g. of 10°. The conveyor belts 3; 4 thus form an outlet nip region 16. Guide rolls 13; 14, which are not driven and which are spaced apart from one another vertically and horizontally, guide the conveyor belts 3; 4 with the belt outer surfaces 11; 12 touching the guide rolls 13; 14, to other subsequent processing stations, such as a longitudinal folding device.

A guide tab or tongue 17, which is fixed to the frame and has the cross sectional shape of a sharp wedge, is disposed between the conveyor belts 3; 4 in the outlet nip region 16. A sharp leading edge 15 of the guide tab 17 points in the direction of the outlet nip region 16, i.e. in the direction of the nip 9 between the cam rollers 1; 2. It is positioned in the immediate vicinity of the nip 9. The guide tab 17 has an acute opening angle B, for example of 10°, and at the sharp leading edge 15, points into the opening, outgoing part of the nip 9, and on the other trailing end, extends in the direction of the guide rolls 13; 14.

The guide tab 17 has upper and lower, straight or curved guide faces 19 and 18 respectively. The signatures 7 and 8 are alternatingly guided past, sliding against these guide faces, or the inner surfaces 21; 22 of the conveyor belts 3; 4 are guided past, likewise sliding against them or spaced slightly apart from them, e.g. by 0.1 mm.

The guide faces 18; 19 can each have a different length. The ends 23; 24 of the guide faces 18; 19, respectively deflection rolls 26; 27 are disposed in the region of the thick trailing end of the guide tab 17 and additional conveyor belts 28; 29 are wound around these deflection rolls.

The second lower conveyor belt 28 rests with its inner surface 31 against the inner surface 21 of the first, lower conveyor belt 3 and constitutes a first continuing signature transport path B for the signatures 7. The second upper conveyor belt 29 rests with its inner surface 33 against the inner surface 22 of the first upper conveyor belt 4 and constitutes a second signature transport path C for the signatures 8 resulting in, split signatures 7, 8. In addition, the first, lower conveyor belt 3, together with the second, lower conveyor belt 28, constitutes a second outgoing conveyor belt system 38, i.e. one that is close to the first cam roller 1. In addition, the first, upper conveyor belt 4, together with the second upper conveyor belt 29, constitutes a third outgoing conveyor belt system 39, i.e. one that is close to the second cam roller 2.

A number of conveyor belts 3; 4; 28; 29 of each conveyor belt system 6; 38; 39 are disposed next to one another in the axial direction on the cam rollers 1; 2.

Spanning over 180° of its circumference and extending uniformly in the axial direction of the first cam roller 1, the first cam roller 1 has a "low" cam 41 with a control face 46 and a low radius r1. Extending over another 180° of its circumference and also extending in the axial direction, the cam roller 1 furthermore has a "high" cam 42 with a control face 47 and a high radius r2.

The stroke height d of the cam roller 1, which may be from two to three millimeters, corresponds to the amount of the difference between the radii r1; r2.

The second cam roller 2 can be embodied the same as the first cam roller 1. The second cam roller 2, however, can also have a number of cams distributed evenly over its circumference, for example, three "low" cams 43, each with a low radius r3 and control faces 48 as well as three "high" cams 44, each with a high radius r4 and control faces 49. The number of cams 43; 44 of the second cam roller 2 is preferably an integral multiple of the number of cams 41; 42 of the first cam roller 1.

The lengths 1 e.g. of the control faces 46 to 49 of the cams 41 to 44 of the cam rollers 1 and 2 are preferably the same, but do not have to be.

A circumference length of the second cam roller 2 that serves as a deflection roller is preferably at least three times the maximal length, e.g. 315 mm, of the signatures to be transported; in the current embodiment, the average circumference length (=e.g. 2,100 mm) of the cam roller 2 is six times the maximal length (=e.g. 315 mm) of the signatures to be transported plus six times the spacing (=e.g. 35 mm).

The entire cam rollers 1; 2 or at least their high cams 42; 44 can be exchanged so that for example, instead of the above-described "six field" cam roller 2 (3 high cams having 3 low cams) a "four field" cam roller with the same circumference length (and with two high cams, whose lengths correspond to twice the length of the cams of the six field cam roller, can be used with a matching counter roller. With this "four field" cam roller, for example a division of the flow of signatures into two partial N.E flows is, wherein in alternating fashion, one partial flow is supplied with two signatures one behind the other and a second partial flow is supplied with only one respective signature.

The cams 43; 44 each extend, for example, constantly in the axial direction of the second cam roller 2. A stroke height e of the cam roller 2 corresponds to the stroke height d of the cam roller 1.

It is also possible to provide a number of cams 41, 42; 43, 44 spaced apart in the axial direction of the cam roller 1; 2.

The operation of the device for distributing a flow of signatures in accordance with the present invention is as follows. Signatures 7 and 8 that are spaced apart from each other are guided clamped between the conveyor belts 3; 4 of the first belt system 6 as seen in FIG. 1. The belt system 6 can, for example, travel underneath a lateral cutting device in order to produce the signatures in an approximately vertical direction, until it reaches the second cam roller 2 that also serves as a deflection roller, and by means of this second cam roller 2, it undergoes a direction change of >90°, e.g. 120°. The signatures 7 and 8 then travel one after the other to the outlet nip region 16 between the conveyor belts 3 and 4.

The second cam roller 2 presses with one of its "high" cams 44 against the outside of the conveyor belt 4 and moves it in the direction of the guide tab or tongue 17. The inner surface 22 of the conveyor belt 4 rests against the upper face 19 of the guide tab 17 or travels past the guide face 19 spaced slightly apart from it. Consequently, the upper transport path C for the signature 7 is closed. As a result of the contact of the "low" cam 41 of the first cam roller 1 against the outside 11 of the conveyor belt 3, the transport path B is cleared between the inside 21 of the conveyor belt 3 and the lower guide face 18 of the guide tab 17 in order to receive the signature 7 and for the continued transport to the processing station all as may be seen in FIG 1.

Referring now to FIG 2, transport path C is now cleared in order to receive a signature 8 by virtue of the fact that a "low" cam 43 of the second cam roller 2 acts against the outer surface 12 of the conveyor belt 4. The transport path B is closed by virtue of the fact that a "high" cam 42 of the first cam roller 1, presses against the outer surface 11 of the conveyor belt 3 and moves it in the direction of the guide tab 17. Consequently, the inner surface 21 of the conveyor belt 3 rests against the lower guide face 18 of the guide tab 17 or travels past the guide face 18 spaced slightly apart from it. A signature 36 has already reached the transport path C before the signature 8 enters the upper transport path C.

The cam rollers 1, 2 preferably have an equivalent circumference speed.

A clearance a of the nip 9 is constituted on the one hand between a "high" cam 44 of the second cam roller 2 and a "low" cam 41 of the first cam roller 1 (as seen in FIG. 1) or between a "low" cam 43 of the second cam roller 2 and a "high" cam 42 of the cam roller 1.

In one embodiment, both cam rollers 1; 2 are supported in eccentric bushings, for example, so that the distance 9 can be adjusted.

In summary, the essence of the present invention is comprised in that the first and second conveyor belts 3; 4 are disposed so that they can be cyclically moved back and forth onto the guide faces 18 or 19 of the guide tab 17 respectively associated with them. Cyclic means that, for example, at the same time or almost the same time, a first transport path B is closed at the sharp edge 15 or is closed to as large an extent as possible, and a second transport path C is open at the sharp edge 15 and vice versa.

A closing of a transport path B or C is only required to the extent that a signature 7; 8 cannot penetrate into this transport path B or C, i.e. there can be a slight distance, such as of a few hundredths of a millimeter, between a conveyor belt 3 or 4 and the sharp edge 15 of the guide tab 17. With each closing of a transport path B or C, at the same time, the inner surface 21 or 22 of each conveyor belt 3 or 4 alternatingly cooperates with the sharp edge 15 of the guide tab 17 so that a guidance for the beginning of the signatures 7 and 8 is already formed at the front part of the outlet nip region 16 of the conveyor belts 3 and 4.

With the device according to the present invention, the conveyor belts 3; 4 resting against the cams 41; 42; 43, 44 cooperate directly with the cams 41; 42; 43; 44, unlike in the prior art device in which "high" cams or high curve sections cooperate with the respectively further removed conveyor belt. In addition, no separate ball-bearing supported guide rolls are required for the conveyor belts.

Through the elimination of the guide rollers, an arbitrary number and an arbitrary width of the conveyor belts extending in the axial direction on the cam rollers 1; 2 are possible.

With an increased width of the conveyor belts 3; 4 as well as of the conveyor belts 23; 29, only a slight specific surface pressure of the conveyor belts 3; 4; 23; 29 against the signatures 7; 8; 36 is advantageously required.

The conveyor belts 3; 4 can respectively rest on each other, i.e. one on top of the other, or can be spaced apart from each other, resting next to each other against the control faces 41, 42; 43, 44 of the cam rollers 1; 2.

While a preferred embodiment of a device for distributing a flow of signatures in accordance with the present invention has been set forth fully and completely hereinabove, it will be apparent to one of skill in the art that a number of changes in, for example, the type of press used to print the signatures, the drives for the rollers and the belts, and the like could be made without departing from the true spirit and scope of the present invention which is accordingly to be limited only by the following claims.

What is claimed is:

1. A device for distributing a flow of sheet-like material, such as signatures, into two partial flows of sheet-like materials comprising:

a first rotating roller and a second rotating roller, said first and second rotating rollers cooperating and defining a roller nip;

a conveyor belt system including a first conveyor belt and a second conveyor belt, said first and second conveyor belts exerting a clamping action on the sheet-like material and passing through said roller nip;

an outlet nip region defined by a divergence of said first and second conveyor belts after, in a direction of travel of the sheet-like material, said roller nip;

a guide tab in said outlet nip region, said guide tab having a sharp edge pointing into said roller nip and further having first and second guide faces, each of said first and second guide faces being engagable by an associated one of said first and second conveyor belts; and means to selectively move at least one of said first and second conveyor belts into engagement with said associated first and second guide faces, at least one of said first and second rotating rollers being a first cam roller having a first number of cams defined by at least one high radius control face and at least one low radius control face.

2. The device of claim 1 wherein said at least one high radius control face is engagable with an associated one of said first and second conveyor belts.

3. The device of claim 1 further wherein said second rotating roller is a second cam roller having a second number of cams defined by at least one high radius control face and at least one low radius control face.

4. The device of claim 3 wherein said second number of cams is an integral multiple of said first number of cams.

5. The device of claim 3 wherein said first cam roller has one high radius control face and said second cam roller has more than one high radius control face.

6. The device of claim 1 wherein said control faces on each of said first cam roller have the same length.

7. The device of claim 1 wherein said first cam roller has an axial length and further wherein each of said control faces is continuous along said axial length.

8. The device of claim 1 wherein said first cam roller has an axial length and further wherein each of said control faces is discontinuous along said axial length.

9. The device of claim 1 wherein said first cam roller has an axial length and further wherein said at least one high radius control face is discontinuous along said axial length.

10. The device of claim 1 wherein said conveyor belt system wraps around one of said first and second rotating rollers by at least 45° before, in said transport direction, said roller nip.

11. The device of claim 1 wherein said conveyor belt system wraps around one of said first and second rotating rollers by at least 90° before, in said transport direction, said roller nip.

12. The device of claim 1 wherein said at least one high radius control face is removably secured to said first cam roller.

13. The device of claim 12 further wherein said at least one removably secured high radius control face has a first length and can be replaced by a high radius control face having a second length different from said first length.

14. A device for distributing a flow of sheet-like material, such as signatures, into two partial flows of sheet-like materials comprising:

a first rotating roller and a second rotating roller, said first and second rotating rollers cooperating and defining a roller nip;

a conveyor belt system including a first conveyor belt and a second conveyor belt, said first and second conveyor belts exerting a clamping action on the sheet-like material and passing through said roller nip;

an outlet nip region defined by a divergence of said first and second conveyor belts after, in a direction of travel of the sheet-like material, said roller nip; and means to selectively move said first and second conveyor belts to distribute said flow of sheet-like material, said means including at least one of said first and second rotating rollers, said at least one of said first and second rotating rollers being a deflection roller engagable with its associated one of said first and second conveyor belts which winds around said one of said rotating rollers by at least 45° before, in a direction of transport of said sheet-like materials, said roller nip.

* * * * *